US012650267B2

(12) United States Patent
Kleindienst

(10) Patent No.: US 12,650,267 B2
(45) Date of Patent: Jun. 9, 2026

(54) FIXING DEVICE FOR REINFORCING THE JOINT OF A ROTARY HEAT EXCHANGER

(71) Applicant: Jan Kleindienst, Gladbeck (DE)

(72) Inventor: Jan Kleindienst, Gladbeck (DE)

(73) Assignee: KLINGENBURG GMBH, Gladbeck (DE)

( * ) Notice: Subject to any disclaimer, the term of this patent is extended or adjusted under 35 U.S.C. 154(b) by 249 days.

(21) Appl. No.: 18/274,409

(22) PCT Filed: Jan. 21, 2022

(86) PCT No.: PCT/EP2022/051316
§ 371 (c)(1),
(2) Date: Jul. 26, 2023

(87) PCT Pub. No.: WO2022/199900
PCT Pub. Date: Sep. 29, 2022

(65) Prior Publication Data

US 2024/0302103 A1 Sep. 12, 2024

(30) Foreign Application Priority Data

Mar. 26, 2021 (DE) ..... 1021107629.3

(51) Int. Cl.
*F28D 19/04* (2006.01)
*F28D 11/02* (2006.01)

(52) U.S. Cl.
CPC ..... *F28D 11/02* (2013.01); *F28D 19/042* (2013.01); *F28F 2225/04* (2013.01); *F28F 2275/20* (2013.01)

(58) Field of Classification Search
CPC ..... F28D 19/042
USPC ..... 165/8, 9
See application file for complete search history.

(56) References Cited

U.S. PATENT DOCUMENTS 3,587,723 A 6/1971 Norback
3,702,156 A * 11/1972 Rohrs et al. ..... F28D 19/042 165/10
3,996,997 A * 12/1976 Regan ..... F28D 19/044 165/8
4,191,241 A 3/1980 Brennan
(Continued)

FOREIGN PATENT DOCUMENTS

GB 1341251 B 12/1973
JP S5818090 A 2/1983

*Primary Examiner* — Devon Lane
(74) *Attorney, Agent, or Firm* — Andrew Wilford

(57) ABSTRACT

The invention relates to a fixing device (1) for reinforcing the joint of a rotary heat exchanger (2) which has a hub part (5) and a heat storage part (6) made of corrugated and flat layers that are wound in an alternating manner. The aim of the invention is to reinforce the joint of the rotary heat exchanger with as little technical complexity as possible. This is achieved in that the rotary heat exchanger (2) can be arranged in the fixing device (1) in a stationary manner, the fixing device (1) has a screw drill device (10) which is arranged on the outer circumference of the rotary heat exchanger (2) arranged in the fixing device (1) and by means of which at least one screw spoke (17) can be drilled or screwed from the outer lateral surface (9) of the rotary heat exchanger (2) through the corrugated and flat layers of the heat storage part (6) of the rotary heat exchanger (2) and into the hub part (5) thereof.

8 Claims, 3 Drawing Sheets

(56) References Cited

U.S. PATENT DOCUMENTS

Figure 1:
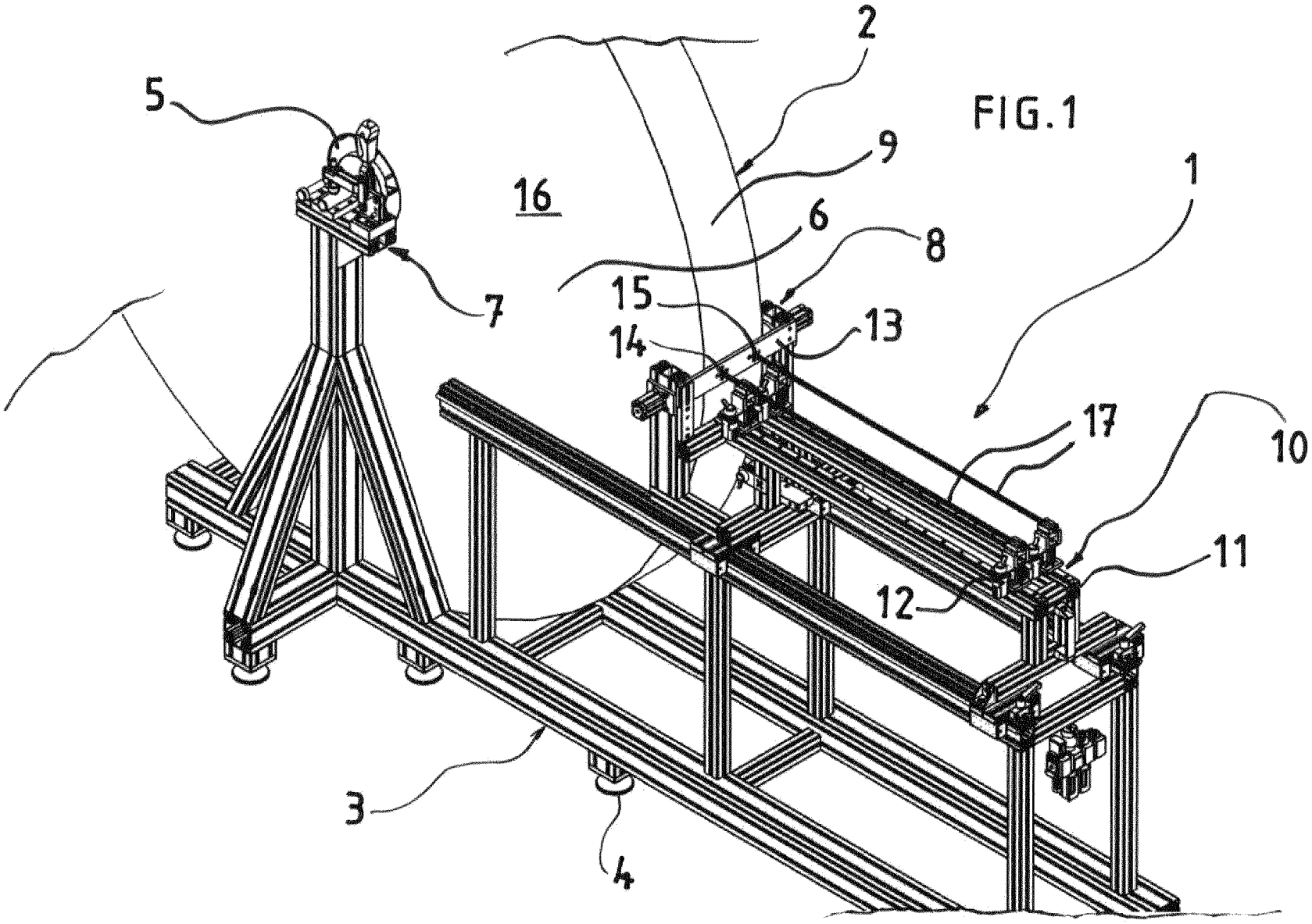

| | | | | | |
|---|---|---|---|---|---|
| 4,307,774 | A * | 12/1981 | Dravnieks | F28D 19/041 | 165/8 |
| 4,337,819 | A * | 7/1982 | Phillips | F28D 19/042 | 165/8 |
| 4,432,409 | A * | 2/1984 | Steele | F28D 19/042 | 264/DIG. 48 |
| 5,085,268 | A * | 2/1992 | Nilsson | F28D 19/042 | 165/8 |
| 6,527,837 | B2 | 3/2003 | Kurosawa | | |
| 2008/0169113 | A1 * | 7/2008 | Rubie | E21B 19/086 | 173/141 |
| 2017/0108287 | A1 * | 4/2017 | Nilsson | F28D 19/044 | |

* cited by examiner

FIXING DEVICE FOR REINFORCING THE JOINT OF A ROTARY HEAT EXCHANGER

CROSS REFERENCE TO RELATED APPLICATIONS

This application is the US-national stage of PCT application PCT/EP2022/051316 filed 21 Jan. 2022 and claiming the priority of German patent application 102021107629.3 itself filed 26 Mar. 2021.

FIELD OF THE INVENTION

The invention relates to a stabilizing apparatus for reinforcing the joints of a rotary heat exchanger having a hub around which a heat storage part made of alternating corrugated and flat layers is wound.

BACKGROUND OF THE INVENTION

In operation, fluids of varying temperatures and pressures flow through such rotary heat exchangers, as a result of which these rotary heat exchangers, and in particular the heat storage parts thereof, which in normal operation are rotated, are in part exposed to considerable stress. Such mechanical stresses can lead to damage of in particular the heat storage part of the rotary heat exchanger, and these stresses may in turn result in considerably restricted operation of such rotary heat exchangers.

OBJECT OF THE INVENTION

Starting from the state of the art described above the object of the invention is to provide a stabilizing apparatus for reinforcing the joints of a rotary heat exchanger, which can ensure with as little technical complexity as possible that damage in particular in the heat storage part of a rotary heat exchanger can be reliably avoided in the long term.

SUMMARY OF THE INVENTION

According to the invention this requirement is met by a stabilizing apparatus for reinforcing the joints of a rotary heat exchanger, in which the rotary heat exchanger can be secured stationarily in a stabilizing apparatus, and the stabilizing apparatus has a screw/drill device juxtaposed with an outer wall of the rotary heat exchanger and that can drill/screw at least one screw spoke from the outer wall of the rotary heat exchanger through the corrugated and flat layers of the heat storage part of the rotary heat exchanger into the hub thereof. Due to the screw spokes being screwed through the heat storage part into the hub, the joints of the rotary heat exchanger are considerably reinforced with little technical complexity. In particular, due to the screw spokes being inserted into the rotary heat exchanger, relative movement of the alternately wound corrugated and flat layers relative to each other is reliably prevented. Furthermore, because the distance between the outer wall of the rotary heat exchanger and the hub thereof has been fixed by the screw spokes, the spacings also between the corrugated and flat layers of the heat storage part of the rotary heat exchanger remain reliably constant.

In order to stationarily secure the rotary heat exchanger in the stabilizing apparatus (fixed spatial assignment) it is advantageous if the stabilizing apparatus has a first stabilizer guide at the hub of the rotary heat exchanger and a second stabilizer guide juxtaposed with the outer wall of the rotary heat exchanger. Given the stationary securing in the stabilizing apparatus, the rotary heat exchanger can then be provided with the screw spokes. After releasing the stabilizer guides the rotary heat exchanger can be brought into another rotary position in the stabilizing apparatus, in which, after fixing the rotary heat exchanger in the stabilizing apparatus by the two stabilizer guides, one or more further screw spokes can be inserted into the rotary heat exchanger.

In order to ensure a reliable directionality for the screw spokes to be inserted into the rotary heat exchanger, it is advantageous if the second stabilizer guide of the stabilizing apparatus, which is juxtaposed with the outer surface of the rotary heat exchanger, has an alignment part with at least one guide hole through which a screw spoke can be drilled/screwed by the screw/drill device into the rotary heat exchanger. This ensures due to the mutual alignment of the screw/drill device on the stabilizing apparatus and of the rotary heat exchanger in the stabilizing apparatus that the insertion of the screw spoke into the rotary heat exchanger takes place in an optimally exact radial direction of the rotary heat exchanger.

If the alignment part has two guide holes that are spaced axially of the rotary heat exchanger from each other, and if both have the same spacing from the respective end wall of the rotary heat exchanger, two screw spokes can be inserted in one operation into the rotary heat exchanger.

The drilling/screwing operation can be performed in a simple manner, if the screw/drill device of the stabilizing apparatus has at least one guide rail extending parallel to a radius of the rotary heat exchanger in the stabilizing apparatus and along which a feed slide of the screw/drill device is movable radially for the purpose of drilling/screwing the screw spoke or spokes into the rotary heat exchanger. It goes without saying that it is of course possible, depending on the layout of the screw/drill device, to insert more than two screw spokes with a single stroke/feed operation into the rotary heat exchanger.

With a method of making a rotary heat exchanger, which is preferably to be realized with the aid of the above-mentioned stabilizing apparatus, a heat storage part of corrugated and flat layers is wound in an alternating manner around a hub of the rotary heat exchanger. A firm joint structure of the rotary heat exchanger is formed in that spoke members extending from the hub thereof to the outer wall of the heat storage part are inserted into the rotary heat exchanger, and screw spokes are used as spoke members of the rotary heat exchanger, which, starting from the outer wall of the heat storage part of the rotary heat exchanger, are screwed into the hub of the rotary heat exchanger through the corrugated and flat layers of the heat storage part of the rotary heat exchanger, with guide holes being formed in the corrugated and flat layers of the heat storage part, until they are, with the under-surfaces of their screw heads, in contact with the outer wall of the heat storage part.

An inventive rotary heat exchanger is manufactured according to the above explained method and thus has a mechanical joint structure that is strengthened/reinforced by screw spokes that have been inserted into the rotary heat exchanger in the above-described manner.

BRIEF DESCRIPTION OF THE INVENTION

Figure 2:
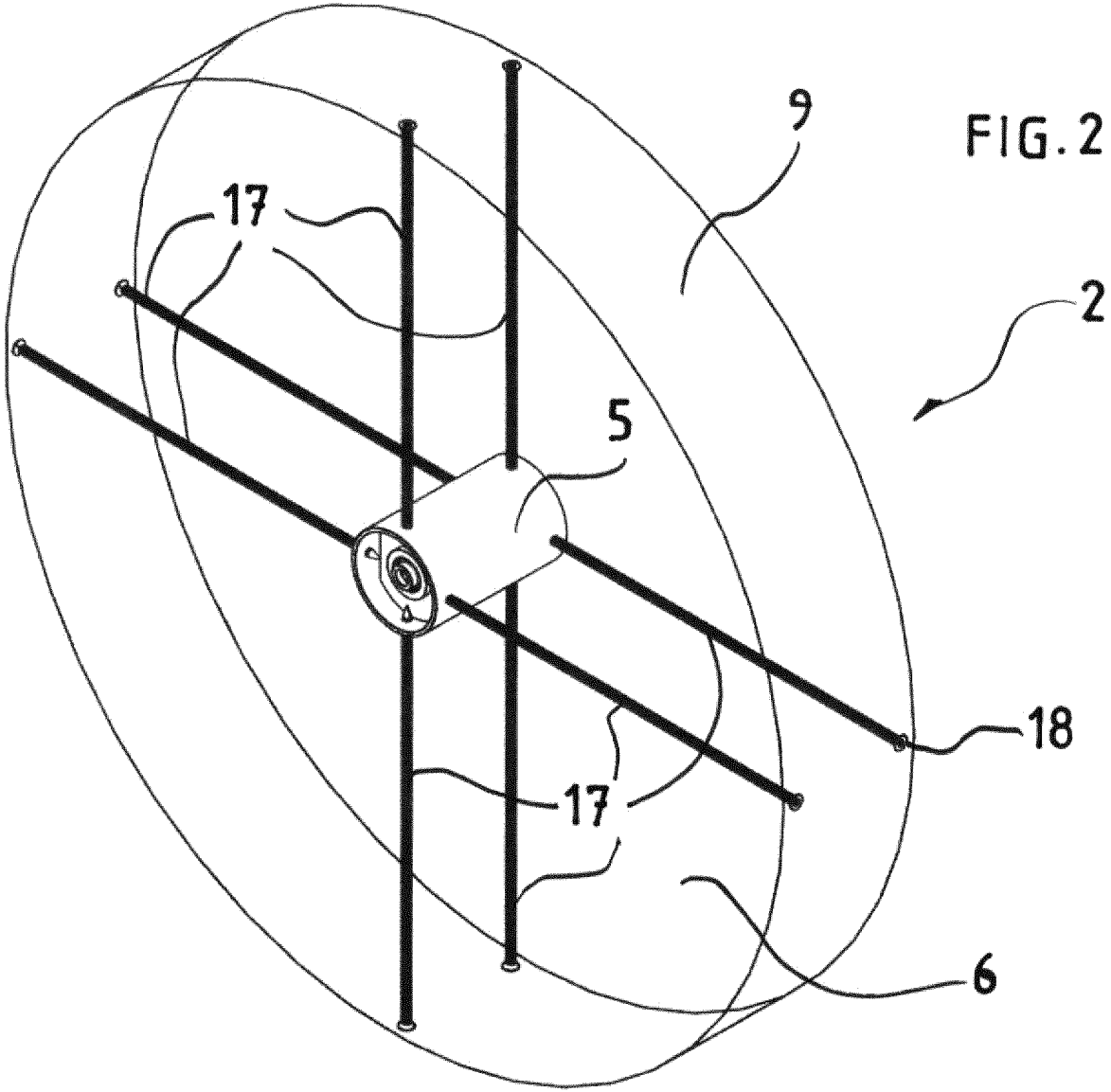
Figure 3:
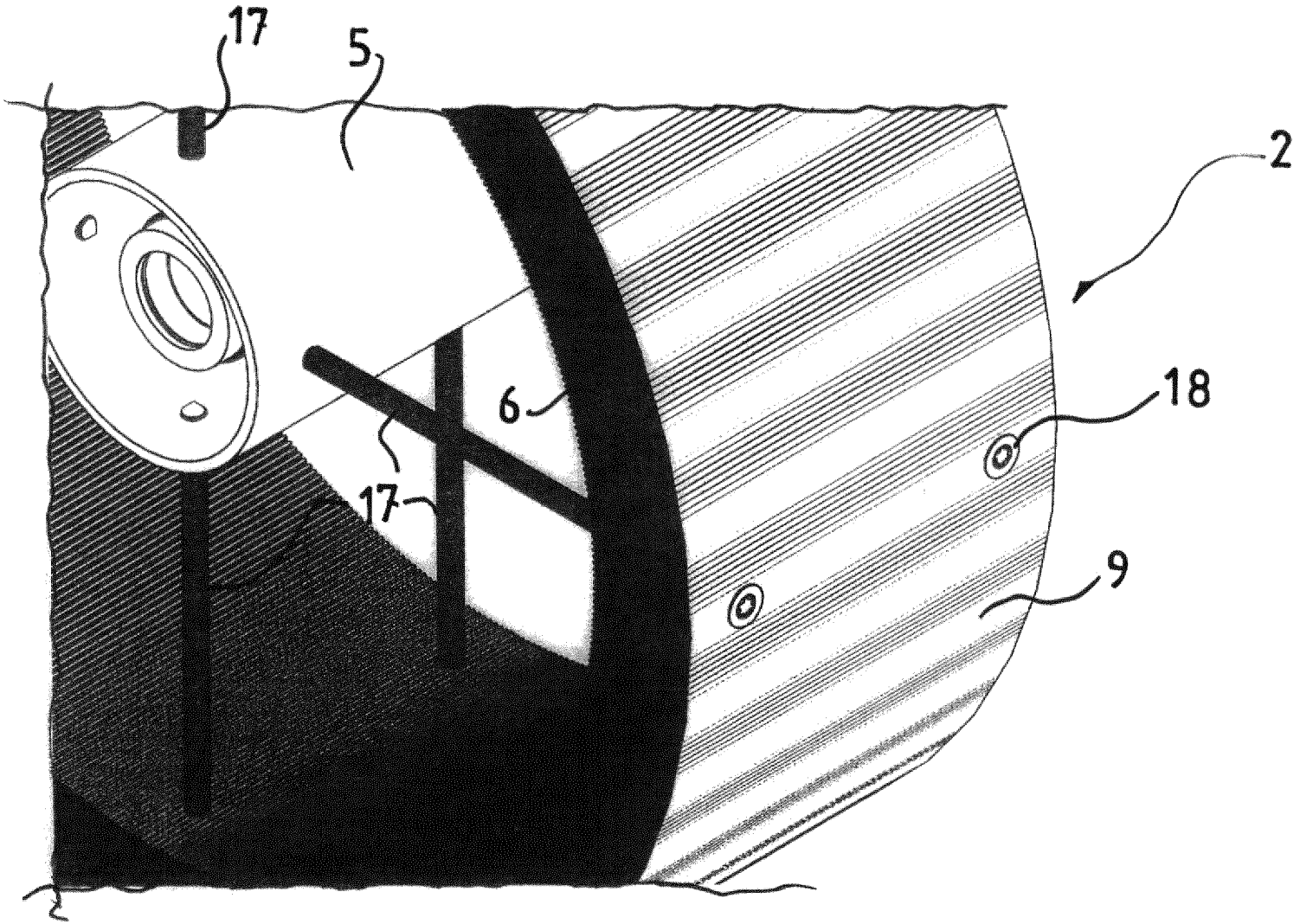

The invention will now be explained by way of an embodiment with reference to the drawing in which FIG. 1 is a perspective schematic view of an embodiment of the inventive stabilizing apparatus for reinforcing the joints of a rotary heat exchanger;

FIG. 2 is a perspective schematic view of a rotary heat exchanger reinforced with regard to its joints in the inventive stabilizing apparatus shown in FIG. 1; and FIG. 3 is a perspective enlarged partial view of a rotary heat exchanger reinforced with regard to its joints in the inventive stabilizing apparatus shown in FIG. 1.

SPECIFIC DESCRIPTION OF THE INVENTION

An embodiment of an inventive stabilizing apparatus 1 shown in FIG. 1 in a schematic view for reinforcing the joints of a rotary heat exchanger 2 also shown in FIG. 1 has a support frame 3 standing on feet 4.

The rotary heat exchanger 2 is set in the stabilizing apparatus 1 or the support frame 3 thereof in a fixed spatial position.

The rotary heat exchanger 2 has a hub 5 and a heat storage part 6 surrounding the hub 5 and formed from alternating wound corrugated and flat layers not shown in detail in FIG. 1.

A first stabilizer guide 7 and a second stabilizer guide 8 are attached to the support frame 3 of the stabilizing apparatus 1.

The first stabilizer guide 7 is on the support frame 3 of the stabilizing apparatus 1 in such a way that this first stabilizer guide 7 can fit tightly into the hub 5 of the rotary heat exchanger 2. The second stabilizer guide 8 is mounted on the support frame 3 of the stabilizing apparatus 1 such that this second stabilizer guide 8 can assume an exact position with respect to a cylindrical outer wall 9 of the rotary heat exchanger 2.

Due to establishing the exact placement between the first stabilizer guide 7 of the stabilizing apparatus and the hub 5 of the rotary heat exchanger 2 as well as the exact positioning of the second stabilizer guide 8 of the stabilizing apparatus 1 and the surface 9 of the rotary heat exchanger 2 on the outer wall of the rotary heat exchanger 2, the rotary heat exchanger 2 can be fixedly positioned relative to the support frame 3 of the stabilizing apparatus 1.

In the region of the stabilizing apparatus 1 of the rotary heat exchanger 2 radially outside the second stabilizer guide 8 of the stabilizing apparatus 1 there is a screw/drill device 10 mounted on the support frame 3 of the stabilizing apparatus 1. This screw/drill device 10 has a guide rail 11 along which a feed slide 12 of the screw/drill device 10 can move longitudinally back and forth.

In the embodiment of the inventive stabilizing apparatus 1 shown in FIG. 1 the second stabilizer guide 8 juxtaposed with the outer wall 9 of the rotary heat exchanger 2 has an alignment part 13 formed with two guide holes 14 and 15. The two guide holes 14 and 15 are spaced from each other parallel to the axis of the rotary heat exchanger 2. The guide holes 14 and 15 are spaced apart about the same as the respective planar end walls 16.

In the embodiment shown in FIG. 1, two screw spokes 17 can be received in the screw/drill device 10. The two screw spokes 17 can be mounted between the feed slide 12 of the screw/drill device 10 on the one hand and the guide holes 14 and 15 of the alignment part 13 of the second stabilizer guide 8 of the stabilizing apparatus 1 in such a way that they extend radially from the rotary heat exchanger 2. The screw/drill device 10 can drill/screw the two screw spokes 17 in them through the corrugated and flat layers of the heat storage part 6 of the rotary heat exchanger 2 fixed stationarily on the support frame 3 of the stabilizing apparatus 1 as far as into the hub 5 thereof.

With this arrangement the screw spokes 17 are screwed by the screw/drill device 10 and the radially biased feed slide 12 from the outer wall 9 of the heat storage part 6 of the rotary heat exchanger 2 through the corrugated and flat layers of the heat storage part 6 of the rotary heat exchanger 2 forming their own guide holes in the corrugated and flat layers of the heat storage part 6 into the hub 5 of the rotary heat exchanger 2. The lengths of the screw spokes 17 and the diameter of the rotary heat exchanger 2 are such that the screw spokes 17 with their radial inner ends relative to the screw/drill device 10 are screwed into the hub 5 of the rotary heat exchanger 2 when screw heads 18 shown in particular in FIG. 3 enter into contact with the outer wall 9 of the heat storage part 6 of the rotary heat exchanger 2.

In the embodiment shown in principle in FIG. 2 of the rotary heat exchanger 2 reinforced with regard to its joints by the inventive stabilizing apparatus 1, eight screw spokes 17 in total were inserted in the above-described manner. To this end the rotary heat exchanger 2 had to be fixed in the stabilizing apparatus 1 in four rotary positions offset by 90 degrees. Each of these screw spokes penetrates the heat storage part 6 of the rotary heat exchanger 2 comprising the corrugated and flat layers from the outer wall 9 thereof up to the hub 5 thereof.

This makes it possible, with comparatively little technical complexity, to considerably reinforce the mechanical joints of the rotary heat exchanger 2. On the one hand this is achieved due to the fact that the corrugated and flat layers of the heat storage part 6 are fixed relative to each other due to the screw spokes 17 penetrating them, and on the other due to the fact that the space between the outer wall 9 of the rotary heat exchanger 2 and the hub 5 thereof is fixed.

The invention claimed is:

1. A stabilizing apparatus for reinforcing joints of a rotary heat exchanger having a hub around which is wound a heat-storage part made of alternating corrugated and flat layers, the apparatus being used in combination with a plurality of screw spokes each having a headed outer end and a pointed inner end, the apparatus comprising in combination:

a frame for holding the rotary heat exchanger stationarily in the stabilizing apparatus; and a screw/drill device juxtaposed with an outer wall of the rotary heat exchanger held in the frame for drilling/screwing at least one of the screw spokes from an outer wall of the rotary heat exchanger through the corrugated and flat layers of the heat-storage part of the rotary heat exchanger and into the hub while forming through the outer wall, corrugated and flat layers, and hub a guide bore until the pointed inner end of the one screw spoke is seated in the hub and the headed outer end of the one screw spoke bears on the outer wall, whereby as the one screw spoke is drilled through the wall, layers and hub it forms its own guide bore.

2. The stabilizing apparatus according to claim 1, further comprising:

a first stabilizer guide fittable into the hub of the rotary heat exchanger and a second stabilizer guide juxtaposed with the outer wall of the rotary heat exchanger.

3. The stabilizing apparatus according to claim 2, wherein the second stabilizer guide has an alignment part with at least one guide hole through which the screw spokes can be drilled/screwed into the rotary heat exchanger by the screw/drill device.

4. The stabilizing apparatus according to claim 3, wherein the alignment part has two guide holes spaced axially of the rotary heat exchanger from each other and both of which have approximately the same spacing as end walls of the rotary heat exchanger.

5. The stabilizing apparatus according to claim 1, wherein the screw/drill device has at least one guide rail extending radially of the rotary heat exchanger in the stabilizing apparatus and a feed slide of the screw/drill device movable longitudinally of the guide rail for drilling/screwing the screw spokes into the rotary heat exchanger.

6. A method of making a rotary heat exchanger in which a heat-storage part made of alternating corrugated and flat layers is wound around a hub of the rotary heat exchanger, and, in order to provide firm joints of the rotary heat exchanger, spoke members extending from the hub thereof to the outer circumference surface of the heat-storage part are inserted into the rotary heat exchanger, the method comprising the steps of:

using screw spokes each having a pointed inner end and a headed outer end as spoke members of the rotary heat exchanger, and screwing the screw spokes from an outer wall of the heat-storage part of the rotary heat exchanger, through the corrugated and flat layers of the heat-storage part of the rotary heat exchanger forming guide bores in the corrugated and flat layers of the heat-storage part, and into the hub of the rotary heat exchanger, until the outer headed of the screw spokes are in contact with the outer wall of the heat-storage part and the pointed inner ends are seated in the hub.

7. A rotary heat exchanger manufactured by a method according to claim 6.

8. An apparatus for stabilizing a heat exchanger rotatable about an axis and having a hub at the axis, a heat-storage part formed by alternating flat and corrugated elements wrapped around the hub, a cylindrical radially outer wall surrounding the heat-storage part, and a pair of axially spaced end walls axially flanking the heat-storage part, the apparatus being used in combination with a plurality of screw spokes each having a headed outer end and a pointed inner end, the apparatus comprising:

a frame adapted to hold the heat exchanger stationarily;

a guide assembly on the frame and extending radially outward from the end wall; and a screwing/drilling device displaceable radially along the guide assembly for screwing at least one of the screw spokes radially inward through the outer wall, through the heat-exchange part, and into the drum and thereby forming a guide bore holding the one screw spoke and extending through the outer wall, the layers, and into the hub until the headed end of the screw spoke radially engages the outer wall and the pointed end is seated in the hub.

* * * * *